US005704675A

United States Patent [19]

Reiley

[11] Patent Number: 5,704,675

[45] Date of Patent: Jan. 6, 1998

[54] BLOCK LIFT

[76] Inventor: R. Patrick Reiley, 3997 Road 6.5 NE., Moses Lake, Wash. 98837

[21] Appl. No.: 588,197

[22] Filed: Jan. 18, 1996

[51] Int. Cl.[6] ..... B66C 1/54

[52] U.S. Cl. ..... 294/95; 294/62

[58] Field of Search ..... 294/93–97, 62, 294/63.1, 86.24, 86.25, 89

[56] References Cited

U.S. PATENT DOCUMENTS

| | | | |
|---|---|---|---|
| 2,507,675 | 5/1950 | Morris | 294/95 |
| 2,558,114 | 6/1951 | Williams et al. | 294/62 |
| 2,823,948 | 2/1958 | Horton | 294/97 |
| 3,519,304 | 7/1970 | Shores | 294/97 |
| 5,490,702 | 2/1996 | Fleming | 294/97 |

FOREIGN PATENT DOCUMENTS

| | | | |
|---|---|---|---|
| 4-80439 | 3/1992 | Japan | 294/93 |

*Primary Examiner*—Dean Kramer

*Attorney, Agent, or Firm*—Miller Nash Wiener Hager & Carlsen llp

[57] ABSTRACT

The invention is a device for attaching a lifting cable or the like to a concrete block or other heavy object. The invention has a pair of pivoting cam members mounted to frame. The frame and cam members are dimensioned so that they can be fit within a space within the block when the device is in a relaxed condition. A linkage, which is connected to the lifting cable, drives the cam members outwardly against the walls of the space when the lifting cable is put in tension. This wedges the device in the space. The greater the tension in the lifting cable, the greater the wedging force.

7 Claims, 10 Drawing Sheets

BLOCK LIFT

TECHNICAL FIELD

This invention relates to devices for lifting concrete blocks and other heavy objects.

BACKGROUND INFORMATION

Many retainer walls are made from individual precast concrete blocks ("retainer wall blocks"). The shape of retainer wall blocks has evolved into a relatively small number of generic designs which are used throughout the construction industry. Although there is some variation in size and shape, retainer wall blocks usually share a common feature: in order to allow the blocks to be interconnected as part of a wall, or to save on the amount of cement used to make each block, or for both reasons, each block has at least one centrally-located opening or recess. The opening is usually near the center of mass of the block and extends through its entire thickness from top to bottom.

Retainer wall blocks are generally very heavy to lift. They are often delivered to a worksite by truck and then must be moved a certain distance from the truck to the location where the wall is constructed. There, each block must be lifted and put into place in the wall.

Because of the size and weight of a typical block, it is difficult for one person to lift, move, and manipulate blocks without help. Most retainer walls require a large number of blocks. Therefore, lifting and positioning all of the blocks required to make a retainer wall can be a grueling task.

Although backhoe/loaders are often present at a wall construction site and can be used to lift and move blocks, it is difficult to connect the blocks to the lifting machinery ("lifting device"). Cables and chains can be used to connect a block to a loader, for example. However, this requires extending the chain or cable around the block or through the block's recess. This is labor-intensive and unwieldy.

The present invention takes advantage of the above-described recess feature present in most precast blocks and provides a way to quickly and efficiently connect a block to a lifting device. Moreover, the invention can be easily adapted to lift other heavy objects which have an equivalent recess feature.

SUMMARY OF THE INVENTION

The invention is a device for lifting a heavy object, wherein the object has a pair of inwardly-facing surfaces. The inwardly-facing surfaces could be opposite sides of a rectangular space, opposite points of a circular opening, or any opposing surfaces of the same or a physically connected structure which are spaced apart a fixed distance. As will become apparent, it is not necessary that the surfaces be parallel— they can be angled slightly relative to each other so long as they generally face each other. It is not necessary that the surfaces be smooth.

The device operates by means of a pair of cam members which are pivotably mounted to a frame. In preferred form, each cam member is a cylindrical disk-shaped member that is mounted to the frame by a pin or bolt at a point that is offset from the center of the disk. Pivoting each cam member causes a portion of its outer surface to rotate outwardly or inwardly relative to the frame, depending on the direction of rotation.

The device must be designed for the particular application in which it is to be used or, in other words, for the size of the recess in the object which is to be lifted. With respect to use in connection with retainer wall blocks, as discussed above, most blocks will have a central opening whose inner dimensions are fixed and uniform. The cam members are spaced apart relative to the frame so that they can be positioned within the opening after they are rotated inwardly a certain amount. Rotating them outwardly causes them to abut against the inner walls of the space. The cam members are linked together in a fashion such that applying a force to the linkage drives them outwardly and wedges them against the inner walls defining the boundaries of the opening. The greater the force applied to the linkage, the more tightly the device is wedged in the opening.

In preferred form, the linkage consists of a combination of components. Connected to each cam member is an elongated cam rod. Applying a momentary force to the cam rod causes rotation of the cam member to which it is connected, according to the direction of the momentary force.

The inner end of each cam rod is threaded into or otherwise connected to its respective cam member. The outer ends of the cam rods extend away from the cam member in a manner so that the elongated axes of the cam rods cross each other. In this manner, the cam rods make up two components of the drive linkage. The third component is a chain which interconnects the cam rods.

The chain interconnects the cam rods in one of two ways, depending on which embodiment of the invention is used. In one embodiment, the cam rods terminate in a hex-head configuration. The end-most links of the chain slide over the length of each rod. Pulling the center-most link of the chain causes the ends of the chain to pull the ends of the cam rods together. This, in turn, drives the cam members outwardly.

In the second embodiment, the cam rods terminate in the shape of an eye-bolt head. The end-most links of the chain are respectively connected directly to each eye-bolt head and pull them together without sliding along the length of the cam rods. Otherwise, the two embodiments function identically.

A more detailed description of the invention follows below.

BRIEF DESCRIPTION OF THE DRAWINGS

In the drawings, like reference numerals and letters refer to like parts throughout the various views, and wherein.

BEST MODE FOR CARRYING OUT THE INVENTION

Figure 1:
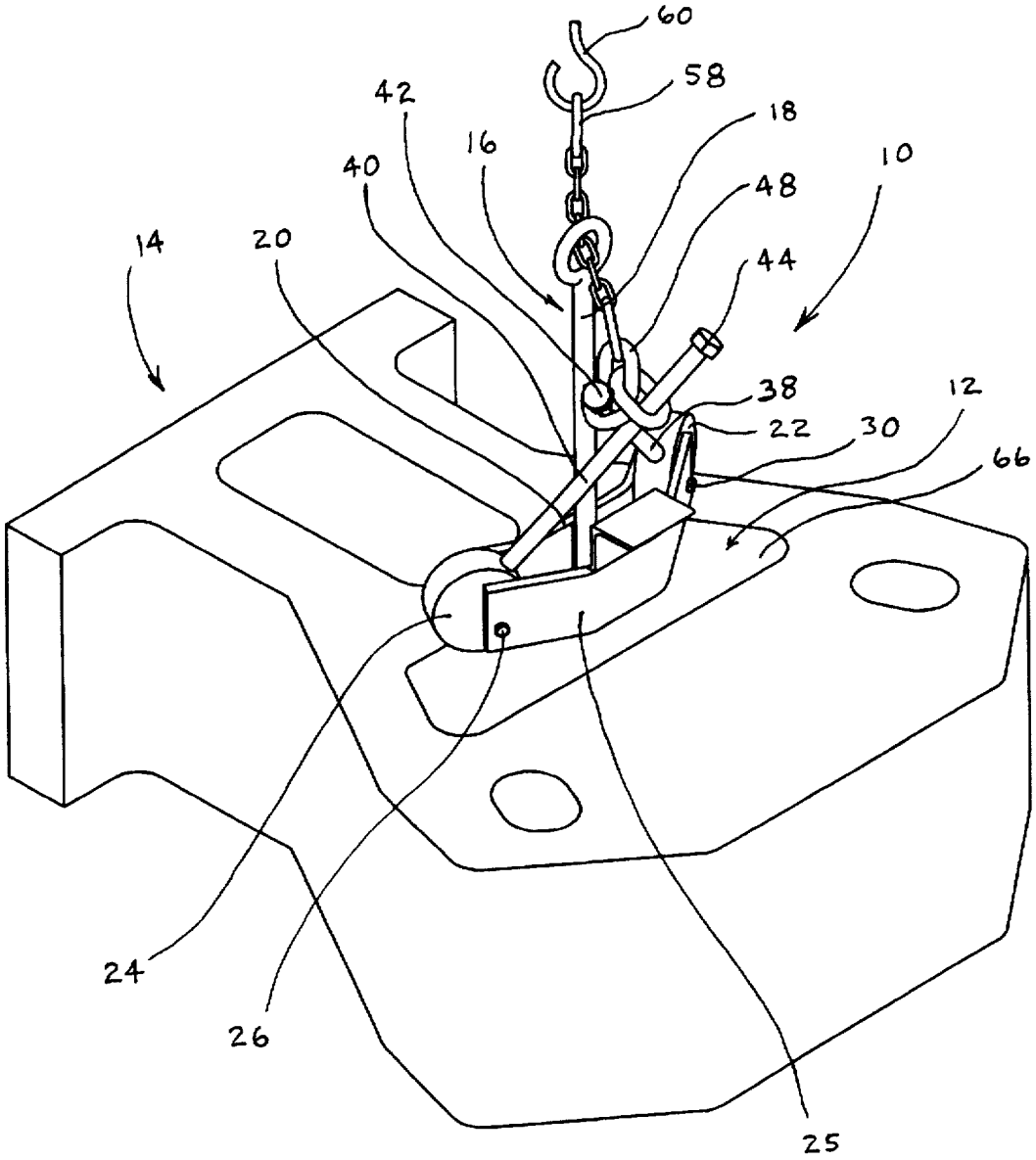
FIG. 1 is a pictorial view of a block lift device constructed in accordance with a preferred embodiment of the invention, and shows the device being lowered into an opening in a precast concrete block.
Figure 2:
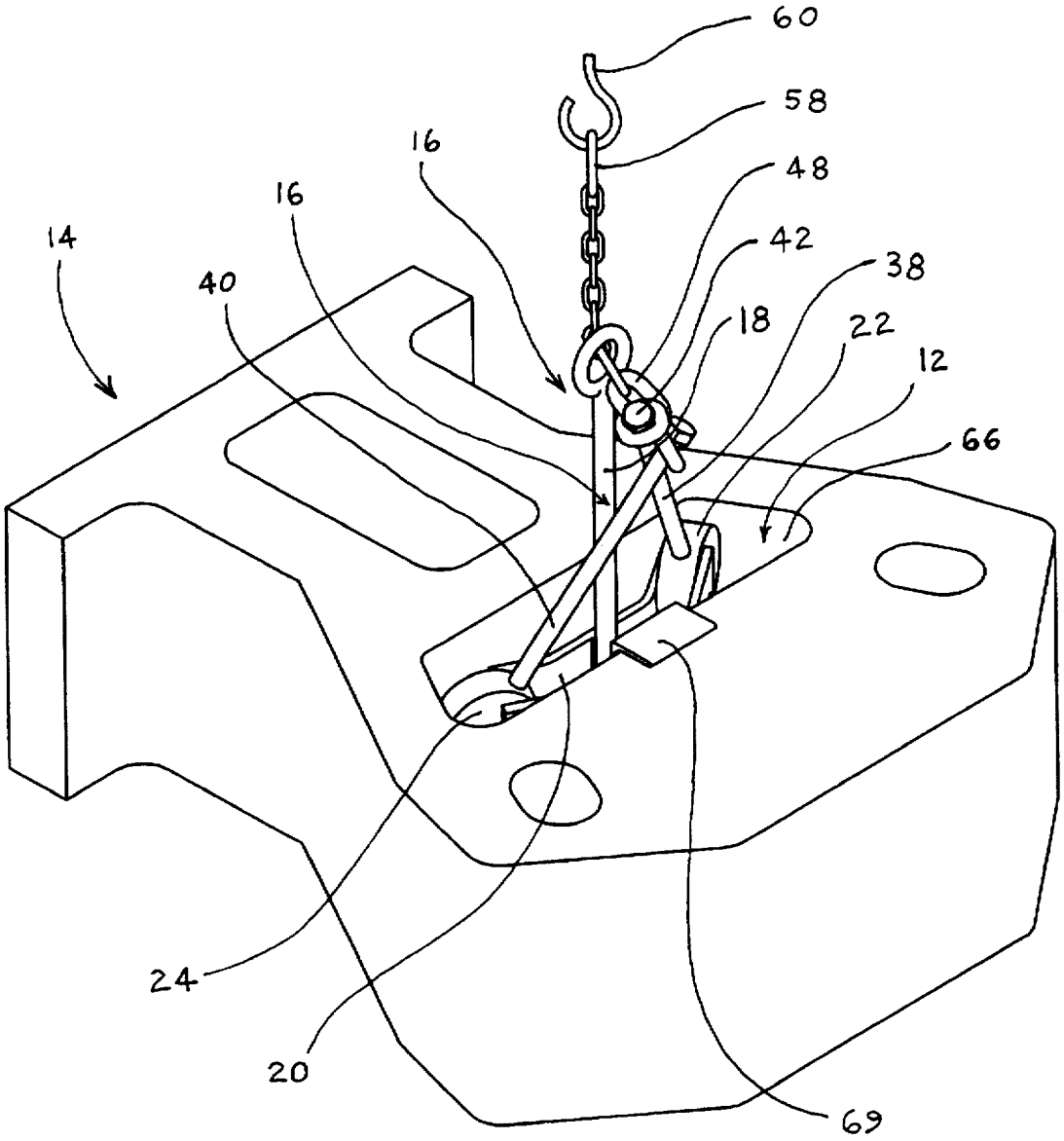
FIG. 2 is a view like FIG. 1, but shows the device in position for lifting the concrete block.

Referring now to the drawings, and first to FIG. 1, shown generally at 10 is a block lift device constructed in accordance with one embodiment of the invention. As will be apparent, this specification describes two embodiments, each of which have the same basic operation for enabling attachment to and lifting of precast concrete blocks or similar heavy items.

The items which are lifted need only have an internal opening or space, or equivalent structural configuration, for allowing a double camming operation as will be further described below.

FIG. 1 shows the device 10 being lowered into an opening 12 in a concrete block 14. As would be apparent to the person skilled in the art, the dimensions of the device 10 must be selected to correspond to the inner dimensions of opening 12. However, as the skilled person would also know, the type of concrete block shown in FIG. 1 is conventional in both size and shape. Consequently, the dimensions of the opening 12 are nearly always the same for the type of block shown.

Figure 3:
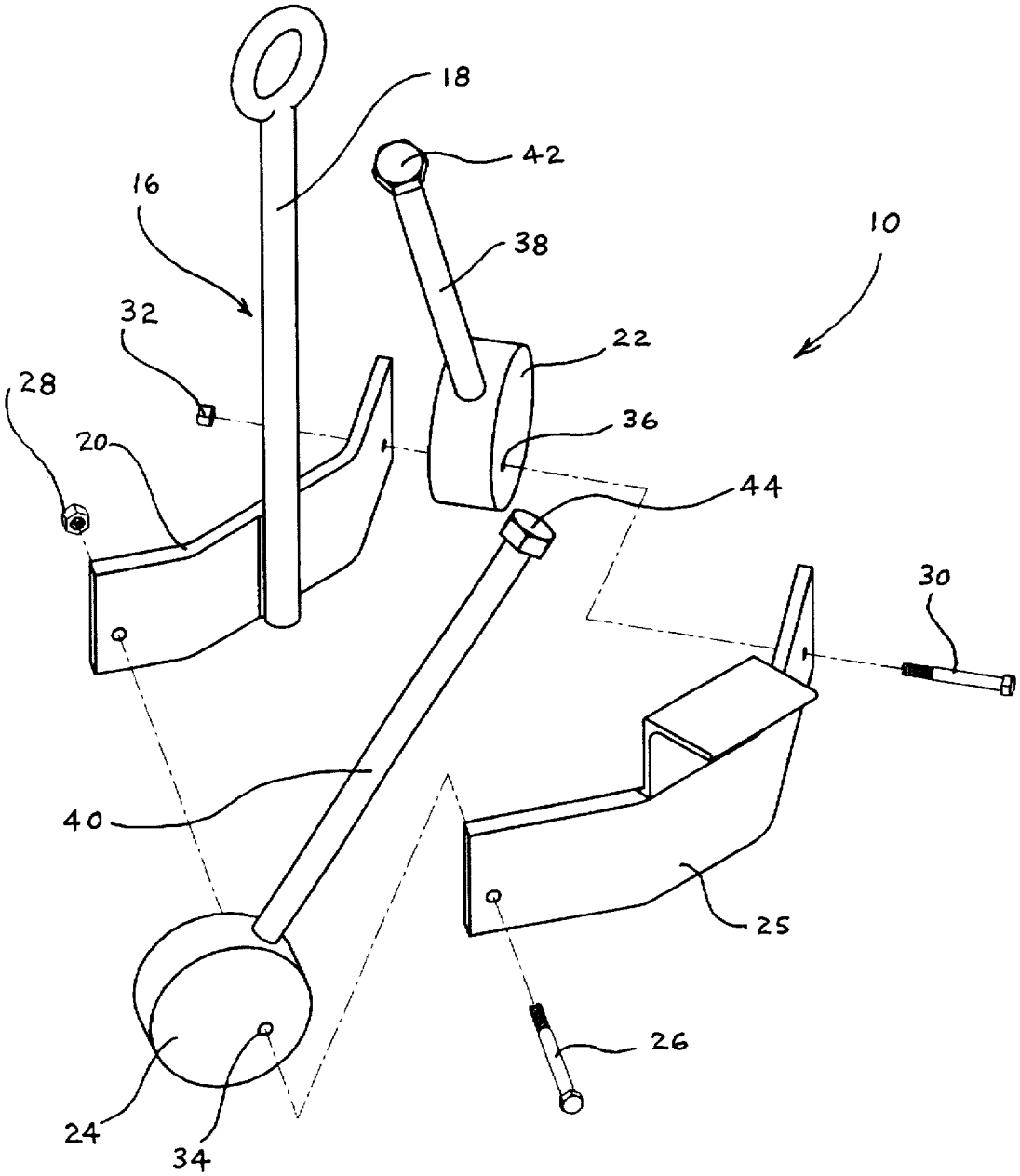
FIG. 3 is an exploded pictorial view of the device shown in FIGS. 1 and 2.

When the device 10 is lowered into the opening 12, it is in a relaxed condition. Referring to FIG. 3, the device 10 consists of a frame 16 having an elongated eye-bolt shaft 18 which is welded or attached to a plate 20 by similar means. Two circular cam members, or cam heads 22, 24, are sandwiched between the plate 20 just described and a second plate 25. The cam heads 22, 24 pivot about the axes respectively defined by the nut and bolt assemblies 26, 28, 30, 32.

The bolts 26, 30 extend through bores 34, 36 in the cam heads 22, 24. The bores 34, 36 are off-center relative to each cam head 22, 24. This causes each cam head 22, 24 to rotate in and out relative to the frame assembly defined by plates 20, 25.

Figure 4:
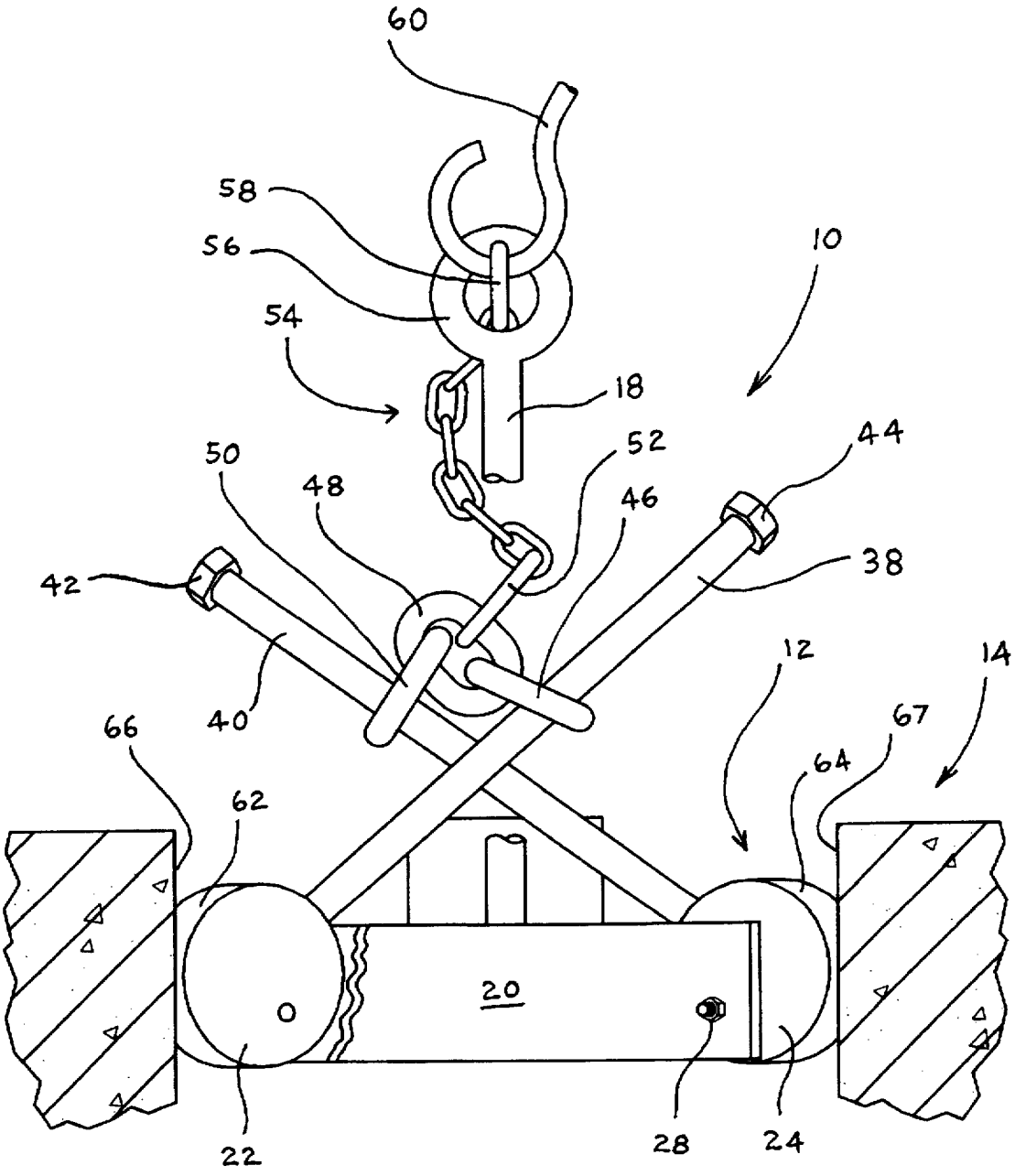
FIG. 4 is a side elevation of the device shown in FIGS. 1–3, and shows the device prior to engagement with an opening in a concrete block.

Each cam head 22, 24 has an elongated shaft or cam rod 38, 40 with a hex-head end 42, 44. Referring to FIG. 4, three links of a chain 46, 48, 50 interconnect the cam rods 38, 40. The outermost links 46, 50 respectively slide along each cam rod 38, 40. The center link 48 is connected to the end-most link 52 of a chain, which is indicated generally at 54. The chain extends through the eye portion 56 of the eye-bolt 18.

The other end-most link 58 of the chain 54 is attached to a lifting hook 60, or the like, which would be further attached to a lifting cable or other chain extending from a construction vehicle or any other mechanical device capable of lifting heavy objects. This would be understood by the skilled person and need not be described further here.

As previously described, and referring to FIG. 4, the device 10 is positioned in the opening 12 when it is in a relaxed condition. In such condition, the cam rod shafts 38, 40 are folded downwardly so that the cam members 22, 24 will be rotated inwardly to the maximum extent possible. This enables the device 10 to be positioned within the opening 12 with the outer surfaces 62, 64 of the cam members 22, 24 being positioned close to but not necessarily abutting the inner surfaces 66, 67 of opening 12. A horizontal flange 69 prevents the device 10 from moving too deeply within the opening 12.

Lifting the hook 60 causes the chain links 46, 50 to slide outwardly toward the hex-head ends 38, 40 of the cam rods 38, 40. This in turn rotates the cam rods 38, 40 outwardly and creates a double camming action where the outer surfaces 62, 64 of the cam members 22, 24 are pressed tightly against surfaces 66, 67. In fact, the greater the lifting force, the tighter the device 10 will be forcibly wedged into the opening 12. This enables the block 10 to be safely lifted and moved to whatever position is desired during a construction operation.

Figure 5:
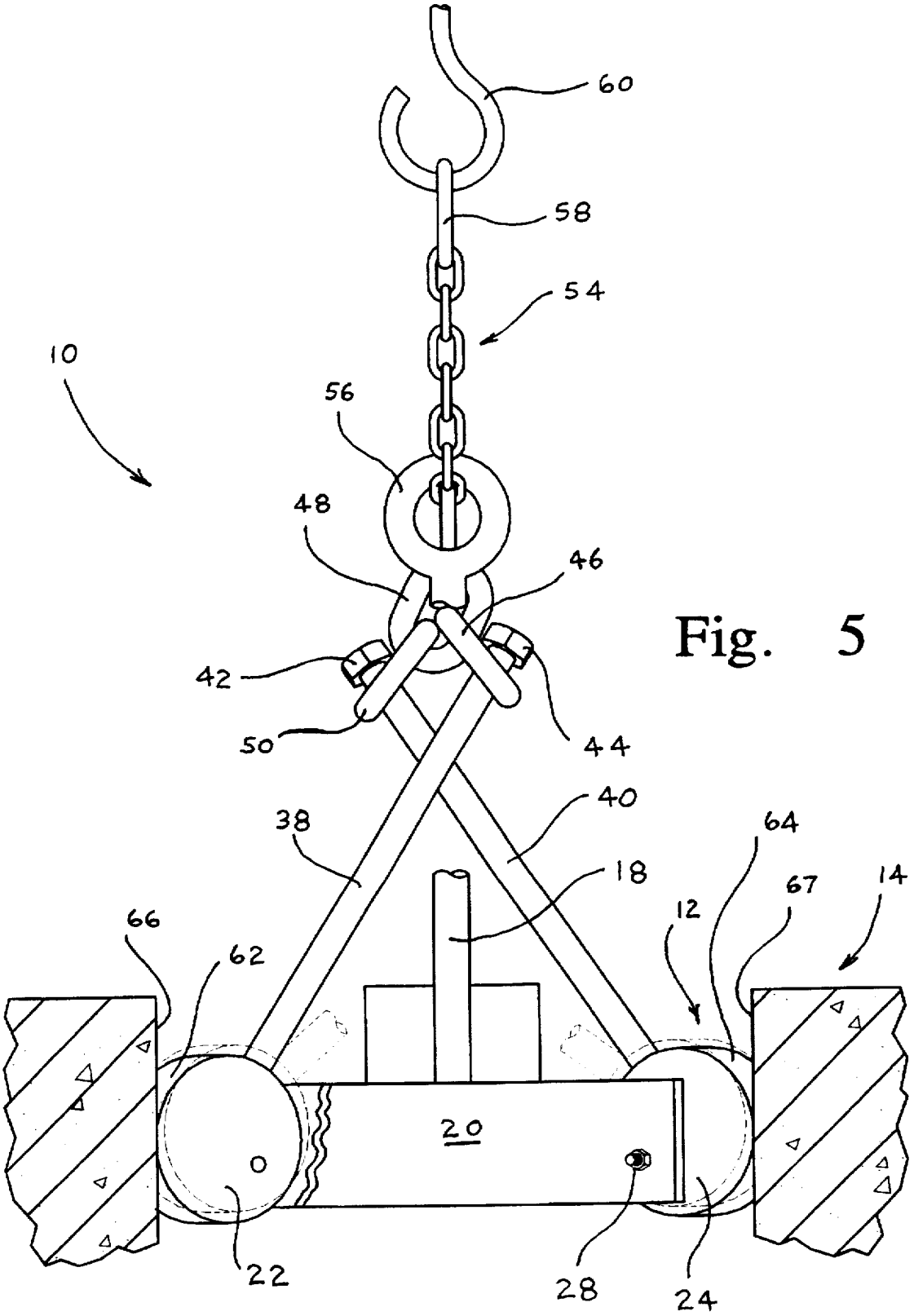
FIG. 5 is a view like FIG. 4, but shows the device in engagement with the concrete block.

The lifting position is best seen in FIG. 5. The dashed lines in FIG. 5 show the difference between the relaxed and lifting conditions as described above.

FIGS. 1–5 show one embodiment of the device 10 which is designed to lift a particular kind of concrete block. The same functional operation may be used in connection with lifting other kinds of blocks or other heavy objects.

Figure 6:
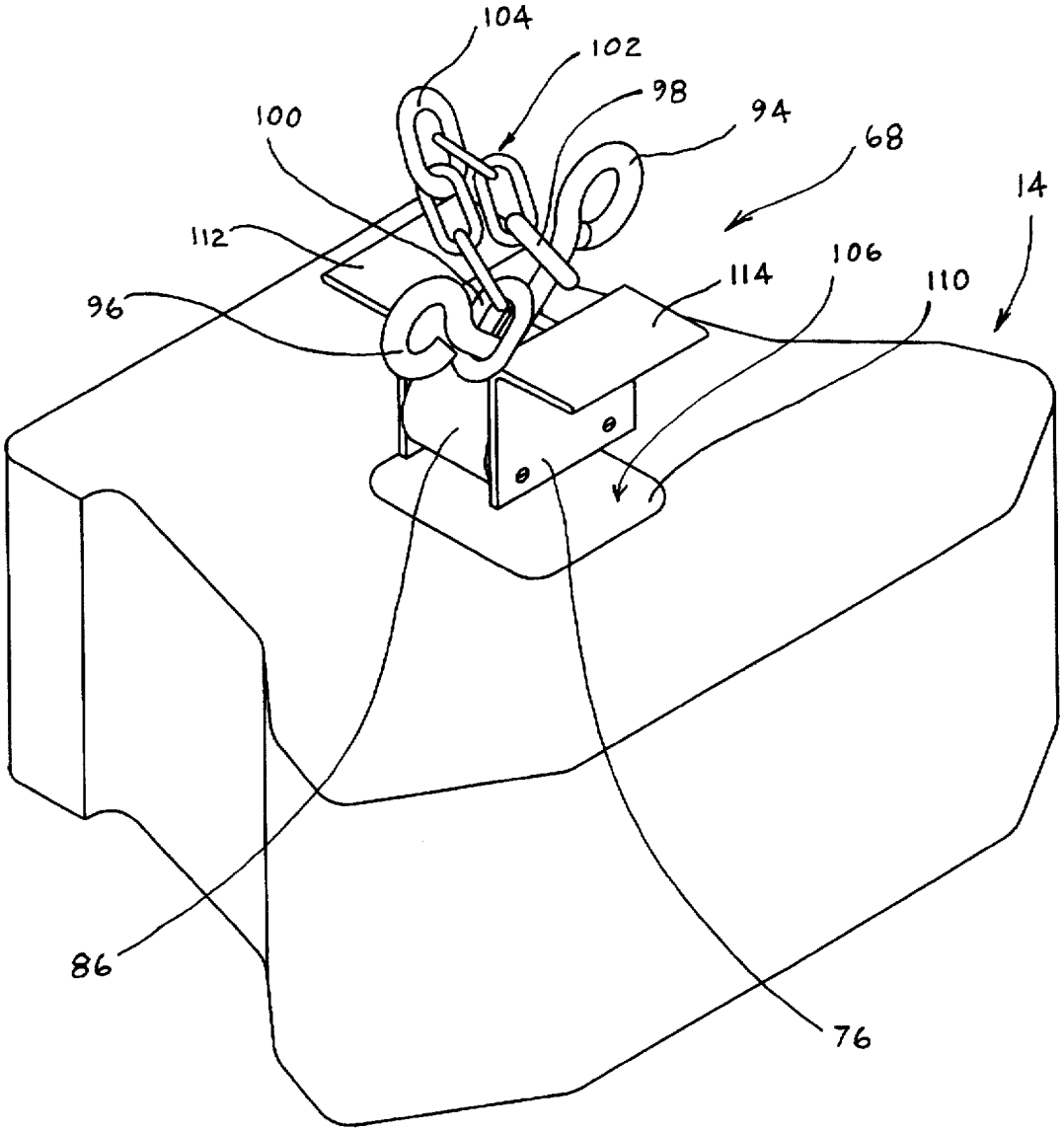
FIG. 6 is a pictorial view like FIG. 1, but shows a second embodiment of the invention.
Figure 7:
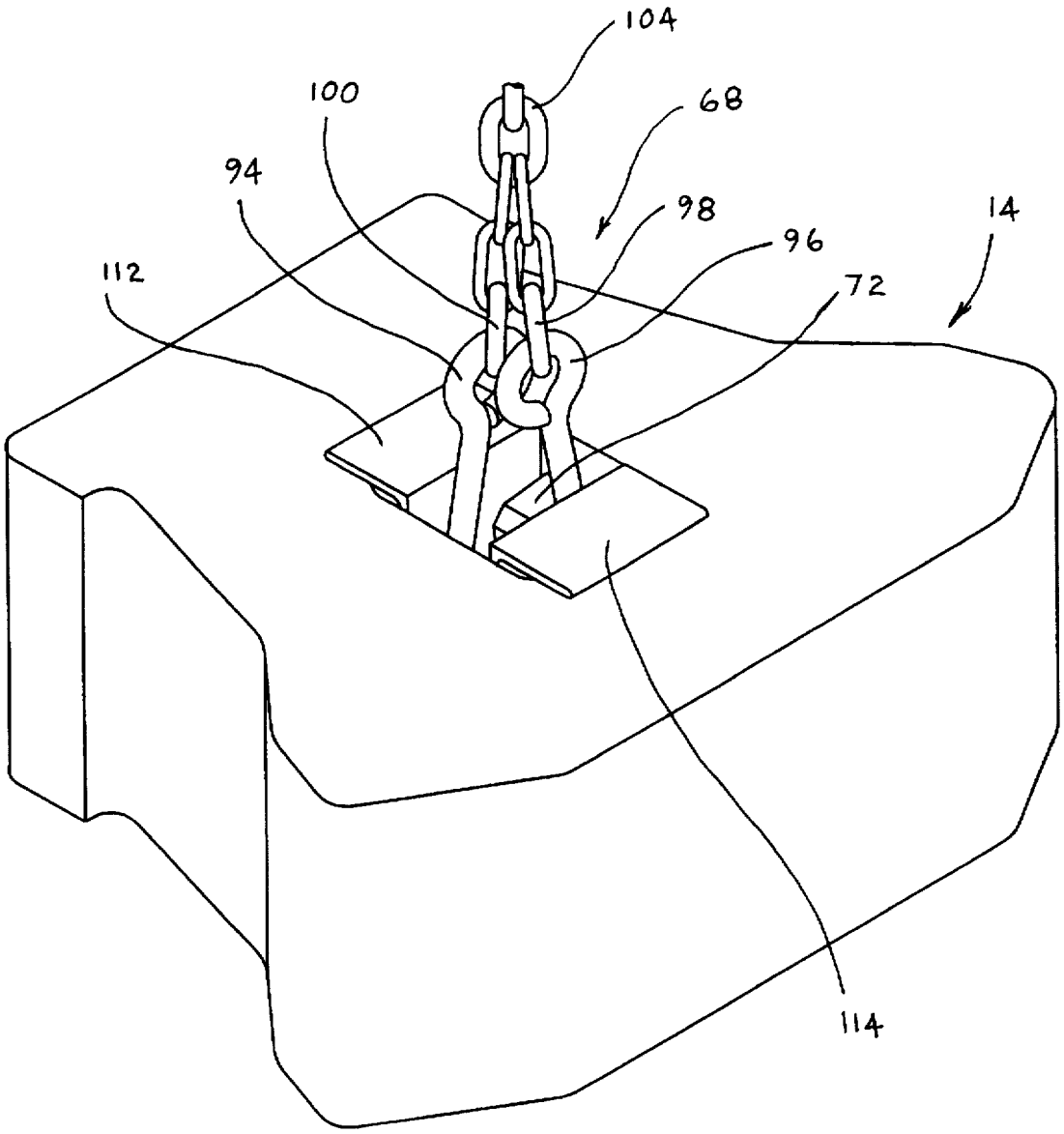
FIG. 7 is a pictorial view like FIG. 2, but shows the second embodiment of the invention.
Figure 8:
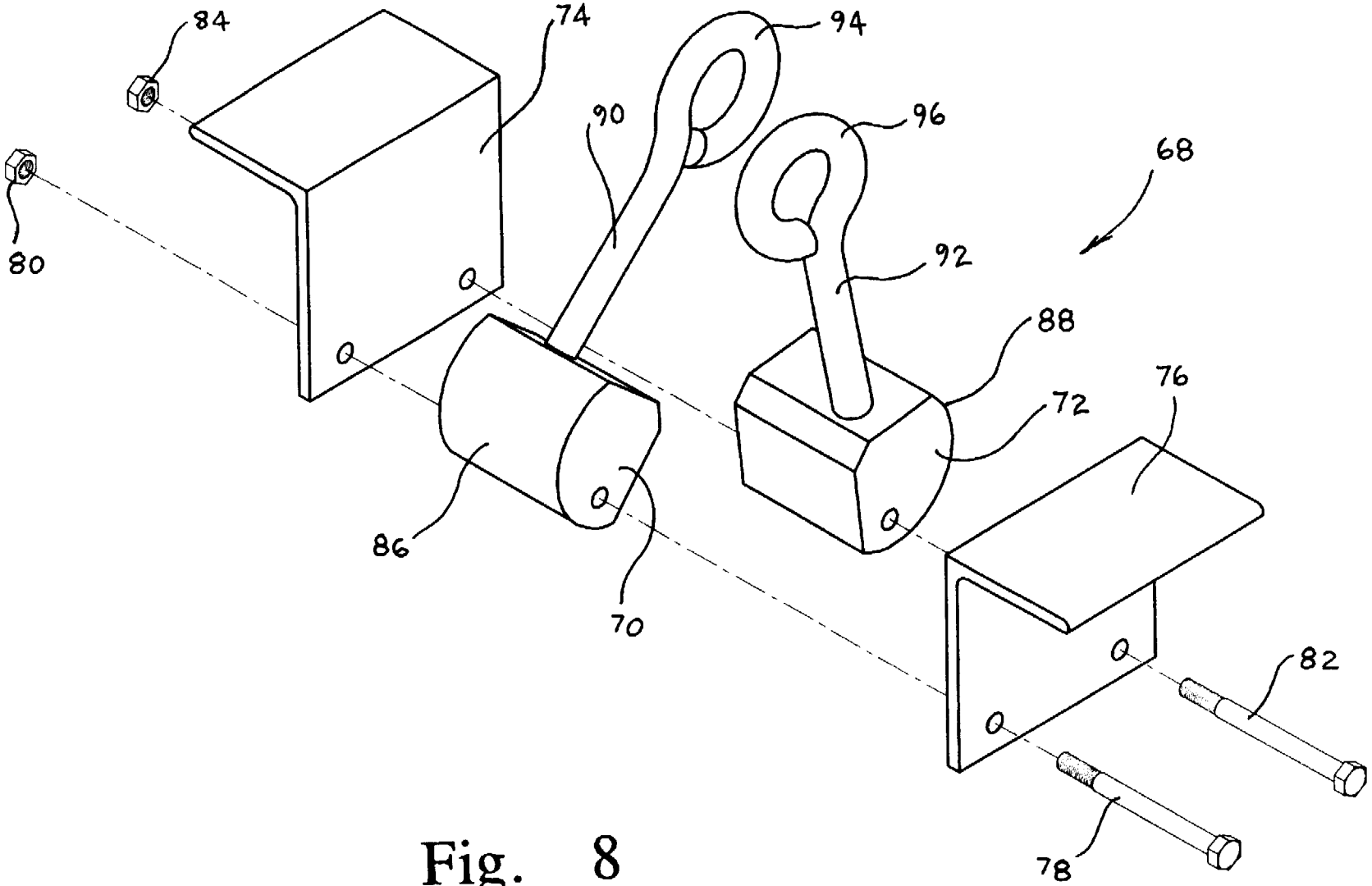
FIG. 8 is an exploded pictorial view of the second embodiment of the invention.

Referring now to FIGS. 6–10, a second embodiment of the invention will be described. FIG. 6 is similar to FIG. 1, but shows another device 68 which operates the same as the device 10 shown in FIGS. 1–5. The device 68 has two cam members 70, 72 sandwiched between a pair of plates 74, 76 (see FIG. 8). The cam members 70, 72 pivot about nut and bolt assemblies 78, 80, 82, 84. The pivotal axis defined by each nut and bolt assembly 78, 80, 82, 84 is off-center relative to the outer arced surfaces 86, 88 of the cam members 70, 72.

Like the device 10 shown in FIGS. 1–5, cam rods 90, 92 are attached to each cam member 70, 72 in the second device 68. However, rather than have the hex-head configuration of the first device 10, the cam rods 90, 92 have eye-bolt heads 94, 96. Connected to each eye-bolt head is an end-most link 98, 100 of a chain, indicated generally at 102. The center-most link 104 of chain 102 is connected to a lifting hook or similar device, like hook 60 shown in FIGS. 1–2 and 4–5. Lifting the center-most link 104 pulls the eye-bolt heads 94, 96 together and rotates cam surfaces 86, 88 outwardly.

Figure 9:
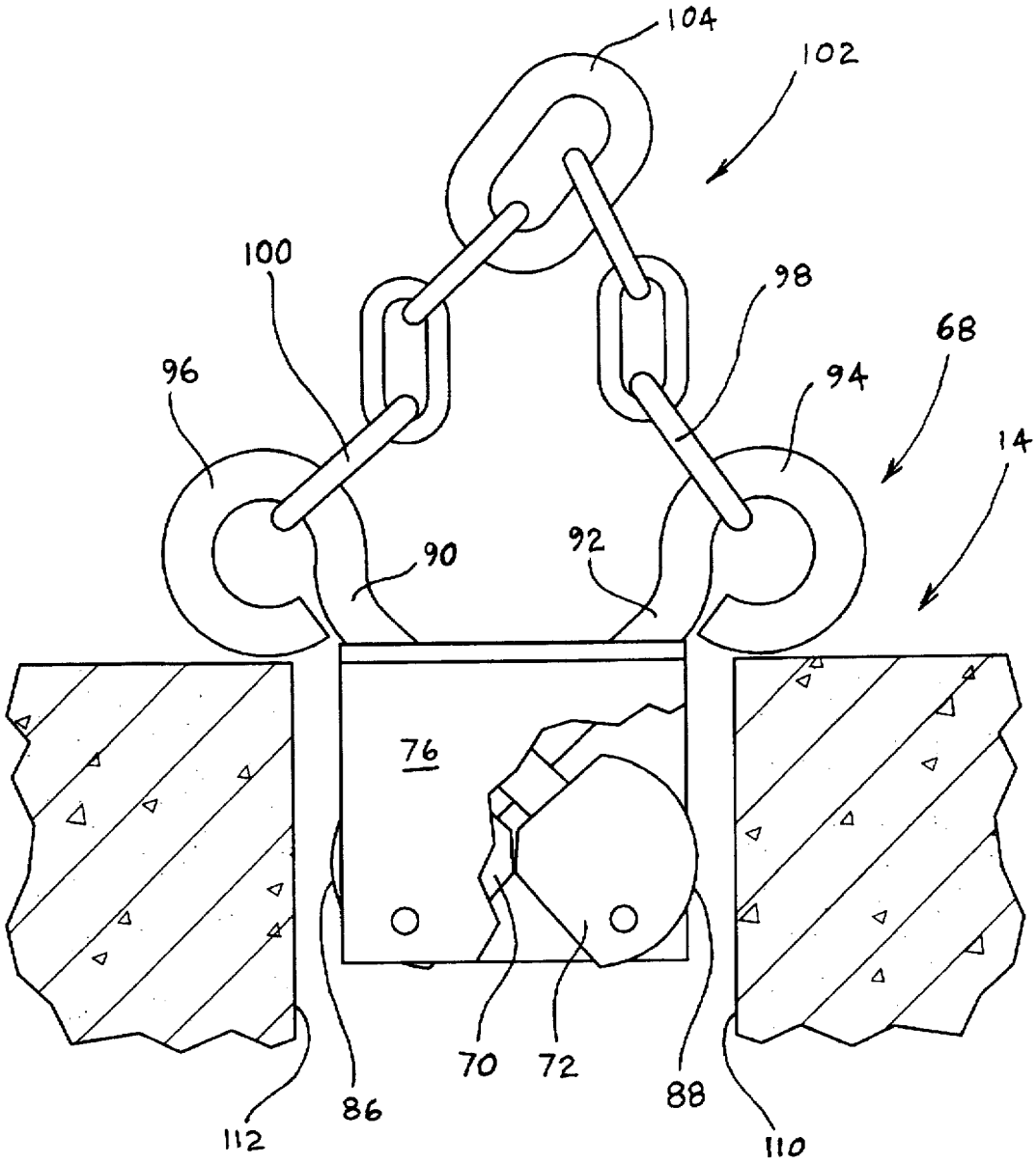
FIG. 9 is a view like FIG. 4, but shows the second embodiment of the invention.
Figure 10:
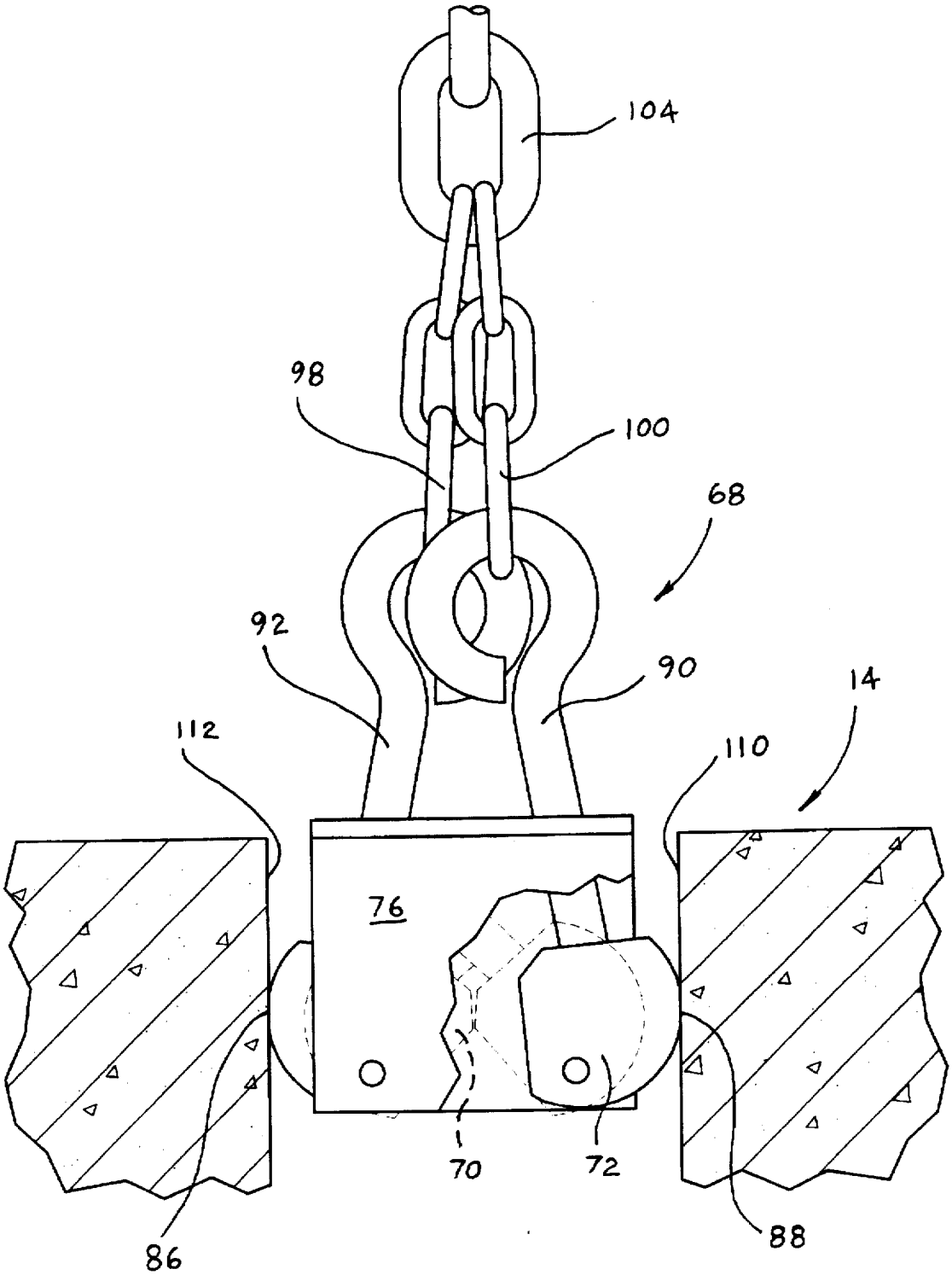
FIG. 10 is a view like FIG. 5, but shows the second embodiment of the invention.

Like the device 10 shown in FIGS. 1–5, the second device 68 is positioned in a block opening 106 (see FIGS. 6 and 9). A lifting cable is then connected to the center-most link 104 and the device 68 is wedged against the inner wall surfaces 108, 110 of the block in the manner shown in FIG. 10. Horizontal flanges 112, 114 prevent the device 68 from moving too far within the opening 106.

The two embodiments described above are designed to lift two types of concrete blocks. As indicated above, however, the double-camming operation of both embodiments could be adapted to lift other kinds of objects. Consequently, the preceding description is not intended to limit the scope of what is considered to be the invention. Instead, the scope of the invention is limited solely by the patent claim or claims which follow, the interpretation of which is to be made in accordance with the established doctrines of patent claim interpretation.

What is claim is:

1. A device for lifting an object, the object having a pair of inwardly facing surfaces, and wherein the device comprises:

a pair of cam members;

a frame for carrying the cam members, wherein the cam members are pivotably mounted to the frame; and a linkage nonpivotably connected to the cam members in a manner such that applying a linkage force to the linkage further causes the linkage to apply a rotational force against the cam members which drives the cam members outwardly relative to the frame, and further, when the device is in use, the cam members are rotated inwardly relative to the frame to a position which enables the cam members to be positioned between the inwardly facing surfaces of the object, and the linkage force is thereafter applied to the linkage to rotationally drive the cam members outwardly against and wedge the device between the inwardly facing surfaces, and still further, the linkage is arranged such that the linkage force causes the rotational force to be applied to each cam member at a cam member location that is between a pivot point where the cam member is mounted to the frame and an outer surface region of the cam member which contacts one of the inwardly facing surfaces.

2. A device for lifting an object, the object having a pair of inwardly facing surfaces, and wherein the device comprises:

a pair of cam members;

a frame for carrying the cam members, wherein the cam members are pivotably mounted to the frame; and a linkage, wherein the linkage comprises a pair of elongated cam rods each having an inner end and an outer end relative to the frame, with the inner end of each cam rod being respectively connected to one cam member, the inner end of the cam rod being connected to the cam member at a location such that an axis defined by the length of the cam rod is offset from and does not intersect the pivot point where the cam member is mounted to the frame, and further, the cam rod axis passes between the pivot point and the inwardly facing surface which the cam member contacts, and wherein the axis of one cam rod crosses the axis of the other cam rod such that applying a linkage force to the cam rods moves the outer ends of the cam rods toward each other, thereby causing a rotational force to be applied to each cam member at a point between where the cam member pivots on the frame and where the cam member contacts the inwardly facing surface, to cause each cam member to respectively rotate outwardly.

3. The device of claim 2, wherein the linkage further comprises:

a chain having at least three links, each endmost link of the chain being connected to one of the elongated cam rods, the centermost link of the chain being adapted to be connected to a member for applying a pulling force to the chain, wherein the pulling force causes the chain to pull the outer ends of the cam rods toward each other and corresponding outer rotation of the cam members.

4. The device of claim 3, wherein each end-most link of the chain surrounds the cam rod to which the link is respectively connected, in a manner so that the link may slide along the length of the cam rod.

5. The device of claim 3, wherein the outer end of each cam rod is in the form of an eye-bolt portion, wherein one end-most link of the chain is connected to the eye-bolt portion of one of the elongated cam rods.

6. A device for lifting a concrete block, the concrete block having a pair of inwardly facing surfaces, and wherein the device comprises:

a pair of cam members;

a frame for carrying the cam members, wherein the cam members are pivotably mounted to the frame and each cam member has an outer circular surface for contacting one of the pair of inwardly facing surfaces of the block when the cam member is rotated in a certain direction; and a pair of elongated cam rods each having an inner end and an outer end relative to the frame, with the inner end of each cam rod being respectively nonpivotable connected to one cam member, and further, the inner end of the cam rod being nonpivotable connected to the cam member at a location such that an axis defined by the length of the cam rod is offset from and does not intersect the pivot point where the cam member is mounted to the frame, and still further, the cam rod axis passes between the pivot point and the inwardly facing surface of the concrete block which the cam member contacts.

7. The device of claim 6, further including:

a chain having at least three links, each endmost link of the chain being connected to one of the elongated cam rods, the centermost link of the chain being adapted to be connected to a member for applying a pulling force to the chain, wherein the pulling force causes outward rotation of the cam members.

* * * * *